US007004380B2

(12) United States Patent
Gunvaldson

(10) Patent No.: US 7,004,380 B2
(45) Date of Patent: Feb. 28, 2006

(54) GUIDED MAILBOX TRAY

(76) Inventor: Gaylord M. Gunvaldson, 912 Gore Rd., Selah, WA (US) 98942

( * ) Notice: Subject to any disclaimer, the term of this patent is extended or adjusted under 35 U.S.C. 154(b) by 0 days.

(21) Appl. No.: 10/833,546

(22) Filed: Apr. 27, 2004

(65) Prior Publication Data

US 2004/0211827 A1 Oct. 28, 2004

Related U.S. Application Data

(60) Provisional application No. 60/465,511, filed on Apr. 28, 2003.

(51) Int. Cl.
*B65D 91/00* (2006.01)

(52) U.S. Cl. ..... 232/29; 232/17

(58) Field of Classification Search ..... 232/29, 232/33, 17; 312/334.1, 334.7
See application file for complete search history.

(56) References Cited

U.S. PATENT DOCUMENTS

| | | | | | |
|---|---|---|---|---|---|
| 838,194 | A * | 12/1906 | Larsh | 232/17 |
| 908,543 | A * | 1/1909 | Brwon | 232/34 |
| 1,848,995 | A * | 3/1932 | Coleman | 232/33 |
| 2,760,721 | A * | 8/1956 | Roberts | 232/33 |
| 3,606,140 | A * | 9/1971 | Shannahan | 232/17 |
| 4,896,827 | A * | 1/1990 | Economou | 232/17 |
| 4,934,592 | A * | 6/1990 | DiMenichi | 232/17 |
| 5,271,555 | A * | 12/1993 | Mayer | 232/17 |
| 6,698,651 | B1 * | 3/2004 | Green | 232/29 |

* cited by examiner

*Primary Examiner*—William L. Miller
(74) *Attorney, Agent, or Firm*—Stratton Ballew PLLC

(57) ABSTRACT

An extendable and retractable mailbox tray, which is a sliding, guided tray that is mountable within into a standard, rural mailbox. The tray extends from the mailbox when the mailbox door is opened, and retracts back within the mailbox when the mailbox door is closed. The guided mailbox tray assembly includes a tray, which may be referred to as a "sled." Preferably, the tray is cut out and bent into the form of a rectangular box from a single sheet of galvanized metal. The tray has a side panel and a runner slot cut within the side panel. A runner with a slot fastener end, and a bracket fastener end that is slidingly mountable into the runner slot. A bracket is mountable to the openable door of the mailbox. The bracket includes a runner fastener that is hingably attachable to the bracket fastener of the runner. The tray extends from the mailbox upon opening the door and the tray retracts back into the mailbox when the door is closed. Preferably, the tray has a pair of side panels, each with a runner slot, a pair of runners, each with a slot fasteners and bracket fasteners, for slidingly connecting the runners to the tray, and pivotably connecting the bracket to the runners.

6 Claims, 6 Drawing Sheets

GUIDED MAILBOX TRAY

This application claims the benefit of provisional Application No. 60/465,511, filed Apr. 28, 2003.

TECHNICAL FIELD

The invention relates to an extendable and retractable mailbox tray or sled, and more particularly to a sliding, guided tray apparatus, mountable within into a standard mailbox, which extends from the mailbox when the mailbox door is opened, and retracts back within the mailbox when the mailbox door is closed.

BACKGROUND OF THE INVENTION

The standard, rural mailbox has a rectangular bottom panel and a U-shaped roof portion extending the length of the bottom panel. It has a back panel at one end and a door at the other end in the shape of the U-shaped roof portion. When removing mail from the conventional mailbox, the recipient must grope into the box to access the mail. If the recipient drives up to the box to retrieve the mail, they must usually extend their body through the vehicle window to get to the mail box. This is inconvenient and uncomfortable for the recipient, and can be dangerous in certain situations. If the brake in the recipient's car or truck is not properly applied, or the transmission accidentally disengages from "park" while the mail is being retrieved, the recipient is in a precarious position, hanging out the vehicle's window. Injury to the mail recipient and damage to the vehicle, the mailbox or surrounding property, are likely results of such a situation.

An improved mailbox with features providing easier access to the mail with would help in the above described scenario. Several prior patent references describe potential improvements to mailboxes, with the stated purpose of providing easier access to the contents within. However, all prior mailbox improvements of this type, so far reviewed, are either too complex, cumbersome, or in another way flawed in their attempt to provide a simple and easy access to the mailed contents within a standard or conventional mailbox.

The present invention is designed to overcome these limitations and provide an easy and full access to the mail within the mailbox. The invention will be better understood by reference to the following detailed description taken in conjunction with the accompanying drawings.

DETAILED DESCRIPTION OF SPECIFIC EMBODIMENTS

Figure 1:
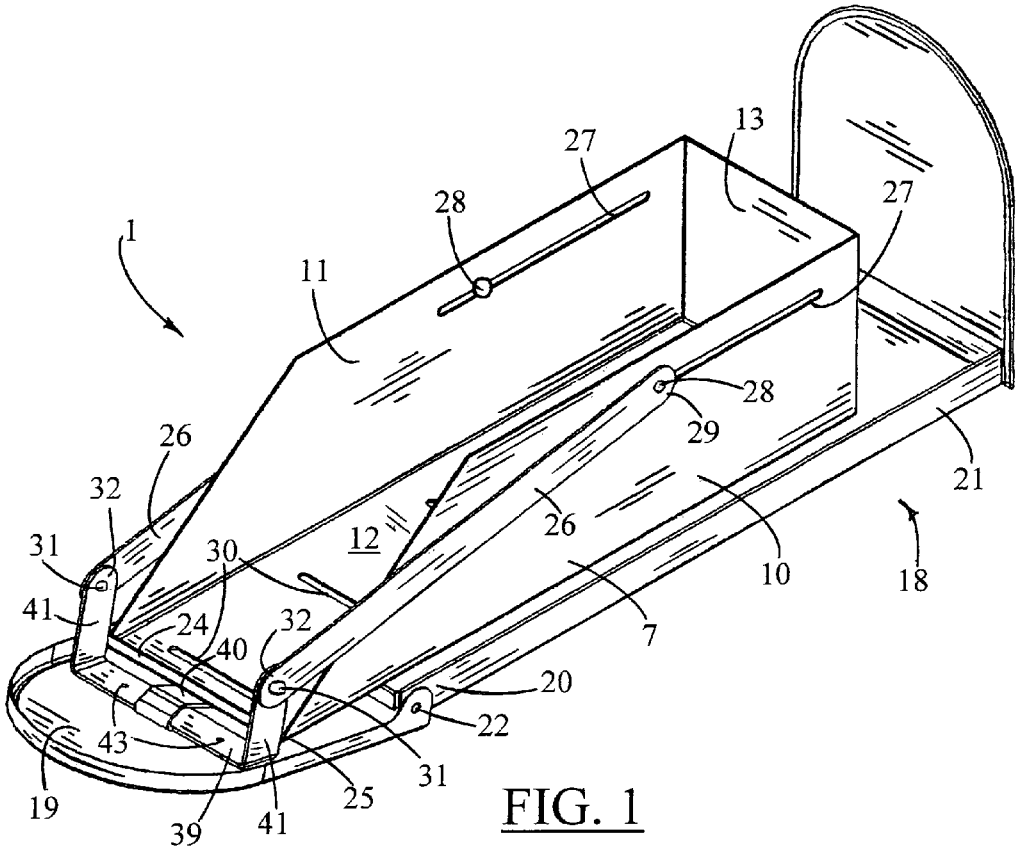
FIG. 1 is a perspective view of a guided mailbox tray, in open position, according to an embodiment of the invention, with the U-shaped portion of the conventional mailbox removed.

The present invention provides a sliding, guided mailbox tray for use with conventional mailboxes. The guided mailbox tray assembly 1 is shown in FIGS. 1 through 6. As shown in FIG. 1, the mailbox guided mailbox tray assembly includes a tray 7, which may be referred to as a "sled." Preferably, the tray is cut out and bent into the form of a rectangular box from a single sheet of metal. Most preferably, a galvanized sheet metal having gauge (ga.) between 12 ga. and 18 ga., with 14 ga. considered as ideal for use with the present invention. Alternatively, the tray may be made of any plastic material, such as an injection molded thermoplastic compound, or alternatively a fiberglass material, any of which are well known to those skilled in the manufacture of such articles.

The tray 7, as shown in FIG. 1, has a right side panel 10, opposite a left side panel 11, with a bottom panel 12 and an end panel 13, between the right side panel and the left side panel. The tray is dimensioned to fit easily within a conventional, standard sized, U.S. Postmaster approved for rural routes mailbox, referred to herein as a "mailbox" 18. These standard mailboxes includes an inverted "U" shaped portion, herein referred to as a "U-shaped portion" 17, which runs the length of the mailbox. A door 19 is positioned at a front end 20 of the mailbox. The door hingably attaches to the mailbox at a door hinge 22. The U-shaped portion of the mailbox typically covers a pan 21. The door includes a door hinge 23, which pivots near the attachment of the pan to the U-shaped portion, at the front end of the mailbox.

Figure 4:
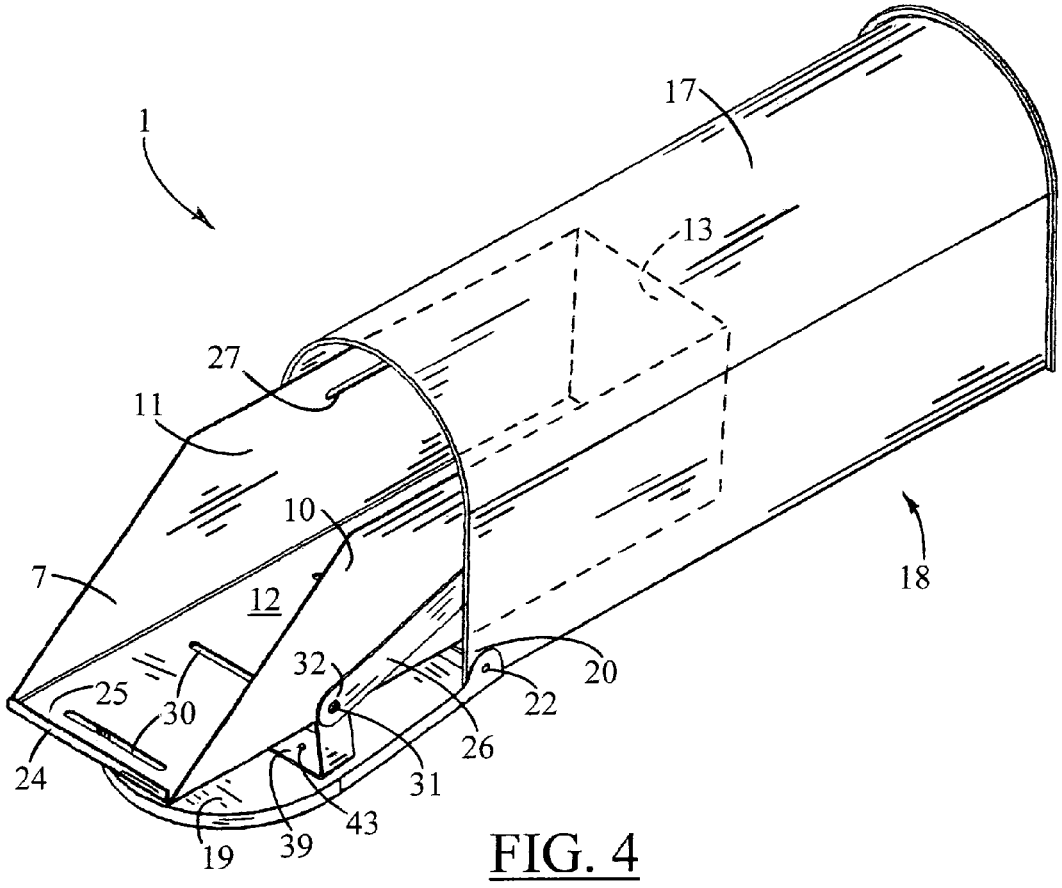
FIG. 4 is a perspective view of a guided mailbox tray, with the tray fully extended, according to an embodiment of the invention.
Figure 5:
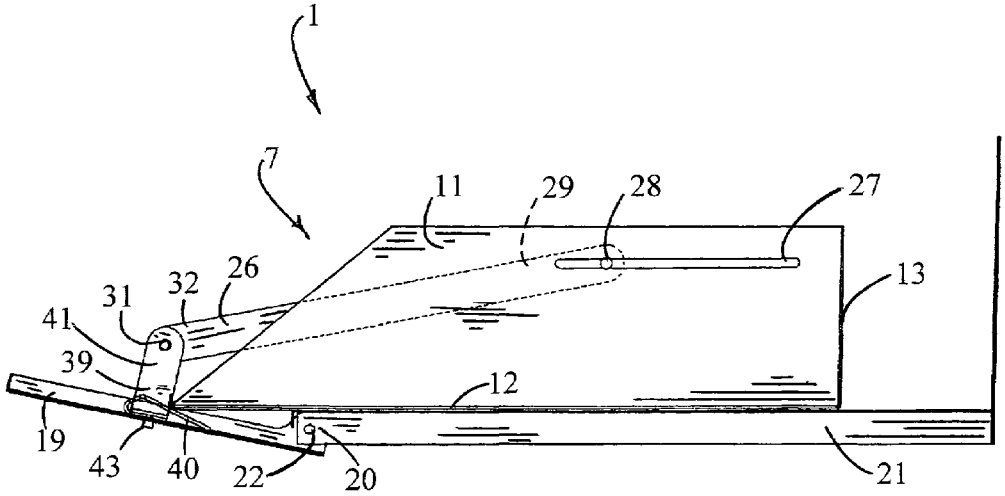
FIG. 5 is a lengthwise sectioned side view of a guided mailbox tray, according to an embodiment of the invention, with the top of the mailbox removed.

Preferably, as shown in FIGS. 4 and 5, the tray 7 also includes a finger lip 24 on a leading edge 25 of the tray. The leading edge of the tray is the end of the tray opposite the end panel and the first end of the tray grasped when the door 19 of the mailbox 18 is opened. In a preferred embodiment of the present invention, the tray is constructed to hold contents in such a way, not to let the contents spill out or get trapped inside the mailbox.

Figure 2:
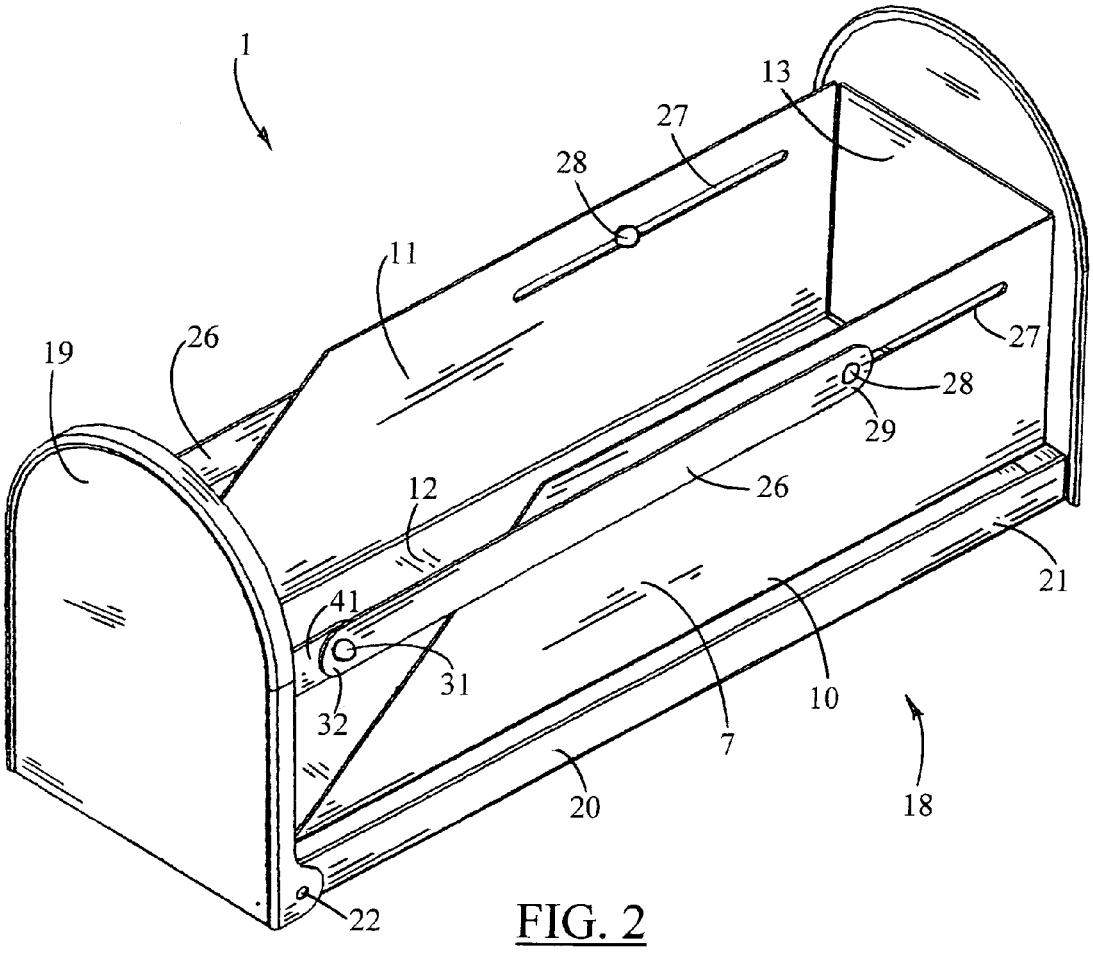
FIG. 2 is a perspective of a guided mailbox tray, in the closed position, according to an embodiment of the invention, with the U-shaped portion of the conventional mailbox removed.
Figure 3:
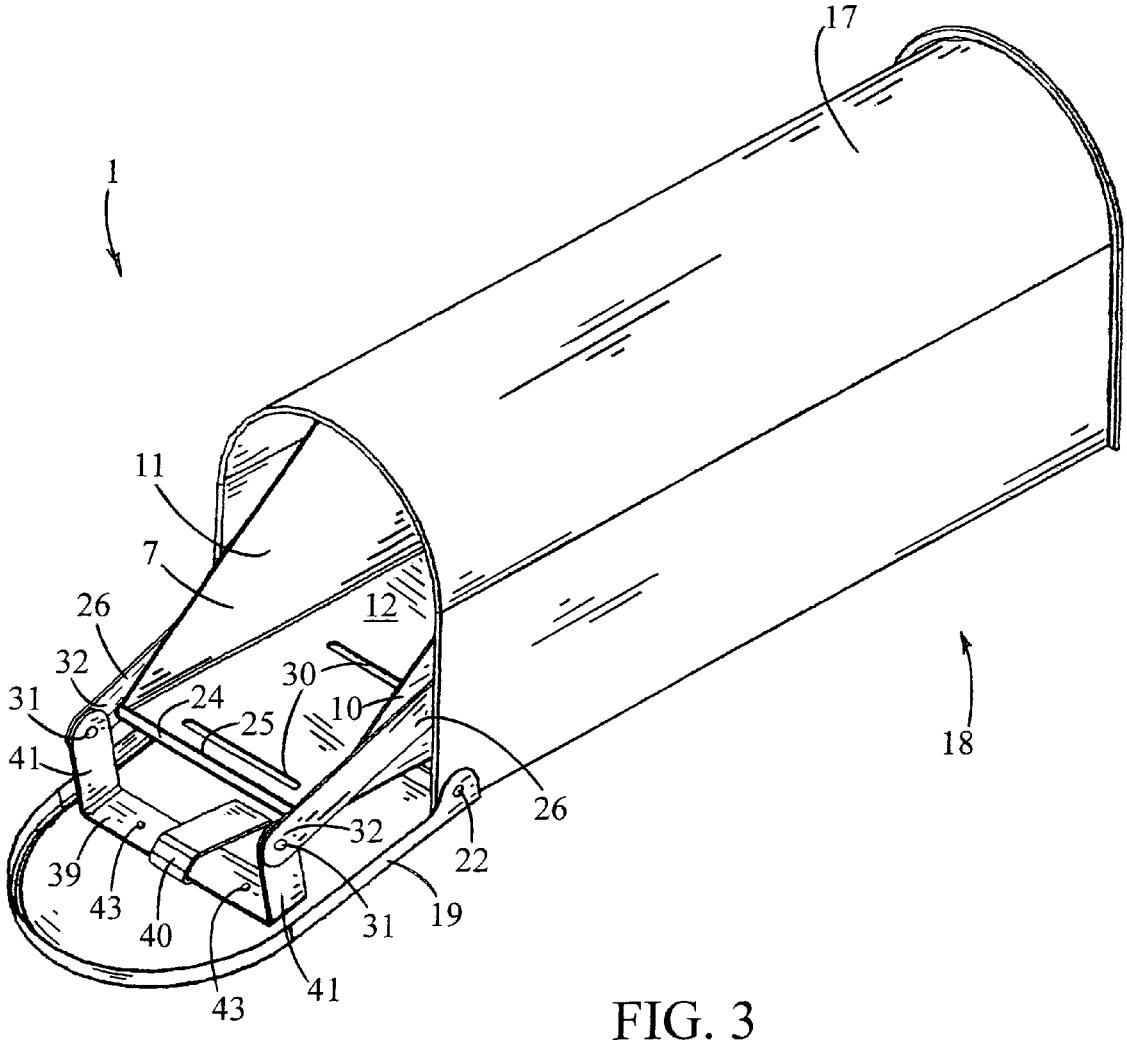
FIG. 3 is a perspective of a guided mailbox tray, when the door of the conventional rural mailbox door is opened, according to an embodiment of the invention.

The tray 7 includes runner slots 27, one each on the left side panel 11 and right side panel 10, toward or near the top of the tray, as shown in FIGS. 1 and 2. A runner 26 slidingly mounts within each runner slot, with a slot fastener 28. This allows the sled runners 26 to travel forward and rearward along the tray, with the opening and closing the mailbox door 19.

Figure 6:
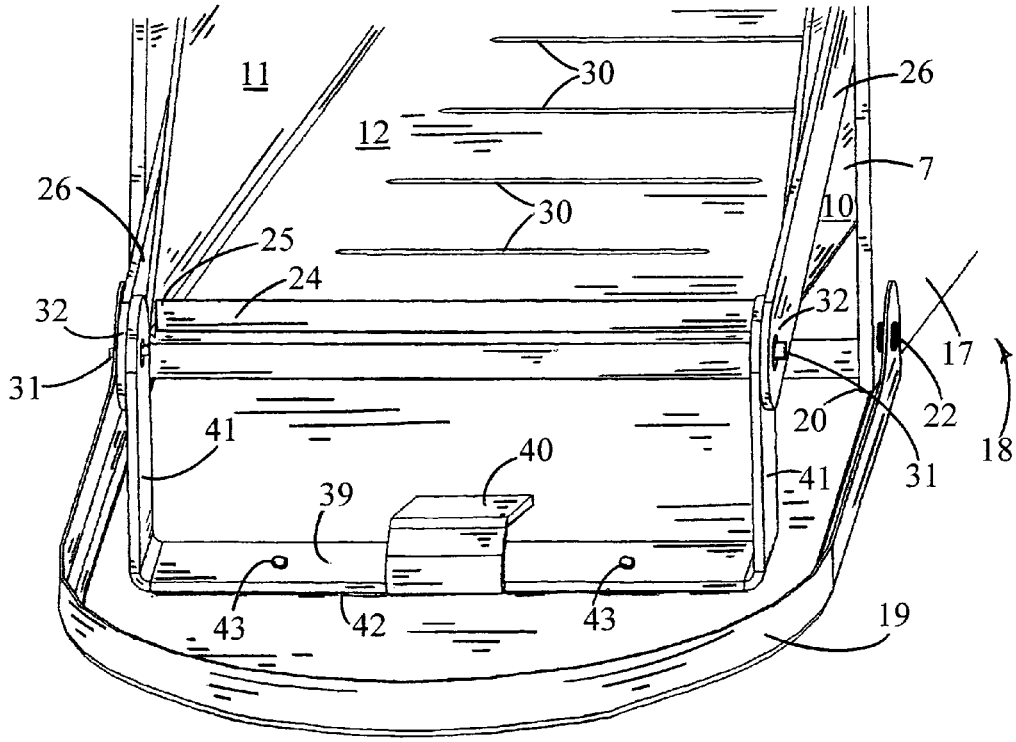
FIG. 6 is a partial, perspective view of a guided mailbox tray, detailing the front of the mailbox and the guided mailbox tray, according to an embodiment of the invention.

In operation, the guided mailbox tray assembly 1, allows the tray 7 to be pulled in and out of the standard mailbox 18. As shown in FIGS. 1, 4 and 6, as an optional addition to the tray, drain slots 30 can be included in the bottom panel 12 of the tray, for water drainage and lightening the weight of the tray. Also, as another preferred option, the finger lip 24 on the leading edge 25 of the tray aids in pulling the tray to its maximum extension from the mailbox, as shown in FIG. 4, by hand.

The runners 26, which serve the right side panel 10 and the left side panel 11 of the tray 7, are preferably identical to one another, and cut out from sheet metal, most preferably galvanized. The runners could also be formed of a plastic, or a fiberglass material. The runners include holes in each end of the runner, in which one of the slot fasteners 28 mount at a slot end 29 of the runner. The slot fasteners are preferably cylindrical caps, and can be made of any material typically used for such a purpose. Most preferably, the slot fasteners are a stainless steel sleeve, or alternatively a hard plastic or a nylon sleeve, selected to slide easily within the runner slots 27. Additionally, a bracket fastener 31 mounts into a bracket end 32 of the runner, the bracket end at the opposite end of the runner from the slot end. The two bracket fasteners are preferably screws or alternatively rivets that pivotably connect the tray to a bracket 39, by attaching the runners 26 to both the bracket and the tray.

A flattened form of the bracket 39 is preferably cut from of sheet metal, and then bent into the desired configuration, as shown in FIGS. 1, 4, 5 and 6. The bracket has a pair of bracket arms 41, which allow the runners 26 to attach by the bracket fasteners 31. A bracket guide 40, as shown in FIGS. 1, 5, and 6, allows easy guiding of the tray 7, back into the standard mailbox 18. Preferably, the bracket ant the bracket guide are galvanized metal, and attach to the door 19 of the mailbox by a length of double-faced tape 42, and a pair of self-taping screws 43, as shown in FIG. 6. As with the tray and the runners, the bracket and the bracket guide can be formed of a plastic or a fiberglass material.

For installing the bracket 39 to the mailbox 18, the length of double-faced tape 42 is first attached to the bracket. Then, when installing the bracket 19 to the door 9 of the mailbox, the remaining protective cover for the double-faced tape is removed, and the bracket is pushed onto the inside of the mailbox door, thus fastening the bracket to the door. In a preferred embodiment of the present invention, to reinforce the bond between the bracket and the door, the pair of self-taping screws 43 are screwed in from the outside face of the door of the mailbox, and into the bracket to make a permanent bond between the bracket and the door. Alternatively, any type of adhesive, or any number of screws, rivets, bolts or similar attachments, could be employed to mount the bracket to the door, as would be known to those skilled in such attachments. Also alternatively, a weld could be employed, such as "spot welding."

As is most preferred, the guided mailbox tray assembly 1 is a hardy device that is economically fabricated, so as to give a long life in operation. As discussed above, the tray 7 is inserted into the mailbox 18, for sliding movement through the front end 20 or "entrance" of the mailbox, and attached to the door 9 of the mailbox by the runners 26, the bracket 39, and the additional fastening hardware.

In an alternative embodiment of the present invention, a single runner 26 attached to a single runner slot 27 and bracket arm 42, could be used to achieve a functioning guided mailbox tray assembly 1. However, the pair of runners, runner slots and bracket arms are most preferred to provide for smooth operation of the guided mailbox tray.

The guided mailbox tray assembly 1 of the present invention is designed to give easy access to the contents of the mailbox 18, by sliding the contents within the tray 7 out to the user or recipient, as they open their mailbox. For a preferred operation of the guided mailbox tray assembly, when the door 19 of the mailbox is closed, as shown in FIG. 2, the guided mailbox tray assembly is folded up entirely inside the mailbox. When the door of the mailbox is opened, the runners 26, and the bracket 39 attached to the door, pull the tray, which holds the mail, out of the mailbox. This action exposes the tray, like a sled, as shown in FIG. 1. The bracket, as attached to the door, pulls the runners, which in turn pulls the tray partially out for access to the contents of the tray. If a user needs further access, deeper into the interior of the tray, the user can put their fingers on the finger lip 24 of the tray, and pull the tray further out of the mailbox, as shown in FIG. 4, to get better access to the contents of the tray. The tray rides over the bracket guide 40, in and out of the mailbox. As the lid of the mailbox is pushed up, to the closed position, as shown in FIG. 5, the bracket guide acts as a "push bar" on the tray, but also when the lid is in a more closed position it acts as a "slide," to let the tray down easily without a sudden drop into the pan 21 of the mailbox.

To close the door 19 of the mailbox 18, the user pushes the tray 7 into the mailbox, approximately as far as the door, as shown in FIGS. 1, 5, and 6. The user then lifts the mailbox door about the door hinge 22. The bracket guide 39, serves to push the tray back into the mailbox, when the door of the mailbox is closed. As shown in FIG. 2, the runners 26 in their collapsed position allow the parts of the guided mailbox tray assembly 1 to occupy a tight configuration.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A guided mailbox tray mountable to a standard mailbox, the standard mailbox including an openable door the guided mailbox tray comprising:

a tray having a side panel and a runner slot within the side panel;

a runner having a slot fastener end and a bracket fastener end;

a bracket mountable to the openable door of the standard mailbox, the bracket including a bracket fastener;

whereby the runner travels forward and rearward along the tray;

a slot fastener of the runner slidingly mountable into the runner slot, and the bracket fastener end of the runner pivotably attachable to the bracket fastener of the bracket; and the tray extendable from the standard mailbox upon an opening of the openable door and the tray retractable back into the standard mailbox upon a closing of the openable door.

2. The guided mailbox tray of the claim 1, further comprising:

a guide bracket, the guide bracket mountable to the openable door of the standard mailbox, the guide bracket for contacting a leading edge of the tray, and guiding the tray into the standard mailbox upon a closing of the openable door.

3. The guided mailbox tray of the claim 1, further comprising:

a finger lip, the finger lip manually pullable to provide for the further extension of the tray from the standard mailbox, the standard mailbox having the openable door in an open position.

4. A guided mailbox tray mountable to a standard mailbox, the standard mailbox including an openable door, the guided mailbox tray comprising:

a tray having a first side panel and a first runner slot within the first side panel;

a first runner having a first slot fastener end and a first bracket fastener end;

the tray having a second side panel and a second runner slot within the second side panel;

a second runner having a second slot fastener end and a second bracket fastener end;

a bracket mountable to the openable door of the standard mailbox, the bracket including a first bracket fastener and a second bracket fastener;

whereby the first runner travels forward and rearward along the tray; and a first slot fastener of the first runner slidingly mountable into the first runner slot, and the first bracket fastener end of the first runner pivotably attachable to the first bracket fastener of the bracket;

whereby the second runner travels forward and rearward along the tray, a second slot fastener of the second runner slidingly mountable into the second runner slot, and the second bracket fastener end of the second runner pivotably attachable to the second runner fastener of the bracket; and the tray extendable from the standard mailbox upon an opening of the openable door, and the tray retractable back into the standard mailbox upon a closing of the openable door.

5. The guided mailbox tray of the claim 4, further comprising:

a guide bracket, the guide bracket mountable to the openable door of the standard mailbox, the guide bracket for contacting a leading edge of the tray, and guiding the tray into the standard mailbox upon a closing of the openable door.

6. The guided mailbox tray of the claim 4, further comprising:

a finger lip, the finger lip manually pullable to provide for the further extension of the tray from the standard mailbox, the standard mailbox having the openable door in an open position.

* * * * *